US010240294B2

(12) United States Patent
Seger et al.

(10) Patent No.: US 10,240,294 B2
(45) Date of Patent: Mar. 26, 2019

(54) CROSSLINKING/FUNCTIONALIZATION SYSTEM FOR A PAPER OR NON-WOVEN WEB

(71) Applicant: GLATFELTER GERNSBACH GMBH & CO. KG, Gernsbach (DE)

(72) Inventors: Bernd Seger, Gaggenau (DE); Jörg Kühn, Ötigheim (DE)

(73) Assignee: GLATFELTER GERNSBACH GMBH, Gernsbach (DE)

( * ) Notice: Subject to any disclaimer, the term of this patent is extended or adjusted under 35 U.S.C. 154(b) by 601 days.

(21) Appl. No.: 14/765,046

(22) PCT Filed: Jan. 7, 2014

(86) PCT No.: PCT/EP2014/050152
§ 371 (c)(1),
(2) Date: Jul. 31, 2015

(87) PCT Pub. No.: WO2014/117964
PCT Pub. Date: Aug. 7, 2014

(65) Prior Publication Data

US 2015/0368864 A1 Dec. 24, 2015

(30) Foreign Application Priority Data

Jan. 31, 2013 (EP) ..... 13153483

(51) Int. Cl.
*D04H 1/425* (2012.01)
*D04H 1/552* (2012.01)
(Continued)

(52) U.S. Cl.
CPC ..... *D21H 19/14* (2013.01); *D04H 1/425* (2013.01); *D04H 1/4266* (2013.01);
(Continued)

(58) Field of Classification Search
CPC ..... D21H 11/20; D21H 17/07; D21H 17/15; D21H 17/24; D21H 17/25; D21H 17/30;
(Continued)

(56) References Cited

U.S. PATENT DOCUMENTS 2,694,633 A * 11/1954 Pattilloch ..... D06M 13/325 162/155
3,293,057 A * 12/1966 Rumberger ..... C08B 31/185 106/214.2
(Continued)

FOREIGN PATENT DOCUMENTS

CA 2 473 638 A1 8/2003
CN 103290720 A * 9/2013
(Continued)

OTHER PUBLICATIONS

Machine Translation of CN-103290720-A. (Year: 2013).*
(Continued)

*Primary Examiner* — Jose A Fortuna
(74) *Attorney, Agent, or Firm* — Blank Rome LLP

(57) ABSTRACT

The present invention relates to a paper or non-woven web, comprising fibers and at least one crosslinking or functionalization agent selected from the group consisting of carboxylic acids, halogenated heteroaromatic compounds and salts thereof, wherein said at least one crosslinking or functionalization agent has a molecular weight of not more than 1000 g/mol, and wherein at least a part of said crosslinking or functionalization agent is bound to said fibers, a process for producing said paper or non-woven web, and the use of said crosslinking or functionalization agent in a paper or non-woven web.

11 Claims, 2 Drawing Sheets

(51) Int. Cl.

| | |
|---|---|
| ***D04H 1/732*** | (2012.01) |
| ***D06M 13/00*** | (2006.01) |
| ***D06M 13/33*** | (2006.01) |
| ***D21H 17/07*** | (2006.01) |
| ***D21H 17/14*** | (2006.01) |
| ***D21H 17/15*** | (2006.01) |
| ***D21H 17/24*** | (2006.01) |
| ***D21H 17/25*** | (2006.01) |
| ***D21H 17/28*** | (2006.01) |
| ***D21H 17/30*** | (2006.01) |
| ***D21H 19/14*** | (2006.01) |
| ***D21H 21/14*** | (2006.01) |
| ***D04H 1/4266*** | (2012.01) |
| ***D06M 101/06*** | (2006.01) |
| ***D06M 13/188*** | (2006.01) |
| ***D06M 13/192*** | (2006.01) |
| ***D06M 13/207*** | (2006.01) |
| ***D06M 13/358*** | (2006.01) |

(52) U.S. Cl.

CPC ..... *D04H 1/552* (2013.01); *D04H 1/732* (2013.01); *D06M 13/00* (2013.01); *D06M 13/188* (2013.01); *D06M 13/192* (2013.01); *D06M 13/207* (2013.01); *D06M 13/33* (2013.01); *D06M 13/358* (2013.01); *D21H 17/07* (2013.01); *D21H 17/14* (2013.01); *D21H 17/15* (2013.01); *D21H 17/24* (2013.01); *D21H 17/25* (2013.01); *D21H 17/28* (2013.01); *D21H 17/30* (2013.01); *D21H 21/14* (2013.01); *D06M 2101/06* (2013.01); *Y10T 442/20* (2015.04); *Y10T 442/277* (2015.04)

(58) Field of Classification Search

CPC ..... D21H 17/37; D21H 19/14; D21H 21/14; D06M 13/00; D06M 13/188; D06M 13/192; D06M 13/207; D06M 13/33; D06M 13/358; D06M 2101/06; D04H 1/425; D04H 1/4266; D04H 1/552; D04H 1/732; Y10T 442/20; Y10T 442/277

See application file for complete search history.

(56) References Cited

U.S. PATENT DOCUMENTS

| | | | | |
|---|---|---|---|---|
| 3,450,555 | A * | 6/1969 | Bridgeford | B01J 13/125 427/389.8 |
| 3,451,890 | A | 6/1969 | Stump, Jr. | |
| 3,905,864 | A | 9/1975 | Curry et al. | |
| 4,548,676 | A | 10/1985 | Johnstone et al. | |
| 4,814,012 | A * | 3/1989 | Paul | B22C 1/2233 106/209.1 |
| 5,129,989 | A * | 7/1992 | Gosset | D21H 23/765 162/147 |
| 5,658,378 | A | 8/1997 | Tsai et al. | |
| 5,906,894 | A * | 5/1999 | West | D21H 11/20 162/129 |
| 5,935,383 | A * | 8/1999 | Sun | D21H 21/20 162/146 |
| 6,171,440 | B1 * | 1/2001 | Staib | C08G 73/0286 162/4 |
| 6,228,218 | B1 * | 5/2001 | Takeuchi | C11D 17/049 162/135 |
| 6,635,755 | B1 * | 10/2003 | Jaschinski | C08B 15/02 536/18.7 |
| 6,673,206 | B1 * | 1/2004 | Linhart | D21H 17/22 162/164.3 |
| 6,821,388 | B2 * | 11/2004 | Marsh | B32B 29/00 162/111 |
| 6,837,972 | B2 * | 1/2005 | Marsh | B32B 29/00 162/111 |
| 7,166,190 | B2 * | 1/2007 | Graef | A61F 13/15617 162/101 |
| 7,473,817 | B1 * | 1/2009 | Tanaka | A61F 13/8405 442/121 |
| 7,592,049 | B2 | 9/2009 | Jones et al. | |
| 8,871,922 | B2 * | 10/2014 | Hu | C08B 15/06 527/312 |
| 2003/0201083 | A1 * | 10/2003 | Marsh | B32B 29/00 162/146 |
| 2003/0203195 | A1 * | 10/2003 | Marsh | B32B 29/00 428/357 |
| 2003/0205342 | A1 * | 11/2003 | Jewell | D21H 11/20 162/9 |
| 2004/0118540 | A1 * | 6/2004 | Garnier | D21H 17/20 162/164.1 |
| 2004/0129632 | A1 | 7/2004 | Le Brech et al. | |
| 2005/0148261 | A1 * | 7/2005 | Close | A61K 8/0208 442/381 |
| 2006/0118255 | A1 * | 6/2006 | Sears | D21C 9/005 162/9 |
| 2006/0292951 | A1 * | 12/2006 | Dutkiewicz | A61F 13/53747 442/79 |
| 2008/0081843 | A1 * | 4/2008 | Weerawarna | B01J 20/262 516/106 |
| 2008/0082067 | A1 * | 4/2008 | Weerawarna | A61F 13/53 604/368 |
| 2008/0147033 | A1 * | 6/2008 | Luo | D06M 11/00 604/367 |
| 2009/0246422 | A1 * | 10/2009 | Nakano | B41M 5/5227 428/32.31 |
| 2009/0308551 | A1 * | 12/2009 | Kokko | D21H 13/20 162/146 |
| 2015/0368864 | A1 * | 12/2015 | Seger | D04H 1/425 442/153 |
| 2017/0241045 | A1 * | 8/2017 | Hartmann | D01F 2/08 |

FOREIGN PATENT DOCUMENTS

| | | | |
|---|---|---|---|
| EP | 0 264 869 | A2 | 4/1988 |
| EP | 0 282 081 | A1 | 9/1988 |
| EP | 0 324 382 | A2 | 7/1989 |
| EP | 0 429 112 | A2 | 5/1991 |
| EP | 0 548 960 | A1 | 6/1993 |
| EP | 0 943 731 | A1 | 9/1999 |
| EP | 1 510 618 | A1 | 3/2005 |
| EP | 1 743 969 | A2 | 1/2007 |
| EP | 2 309 059 | A1 | 4/2011 |
| GB | 1 603 414 | A | 11/1981 |
| JP | 3-206176 | A | 9/1991 |
| JP | 2006-37327 | A | 2/2006 |
| JP | 2010-94666 | A | 4/2010 |
| JP | 2011-514187 | A | 5/2011 |
| RU | 2 281 994 | C2 | 8/2006 |
| WO | WO 96/11193 | A1 | 4/1996 |
| WO | WO 2009/102913 | A2 | 8/2009 |
| WO | WO 2012/118939 | A1 | 9/2012 |

OTHER PUBLICATIONS

Song, Delong in "Starch Crosslinking for Cellulose Fiber Modification and Starch Nanoparticle Formation," Disertation presented to faculty of Georgia Institute of Technology, pp. 1-197. (Year: 2011).*

Martel et al. in "Polycarboxylic Acids as Crosslinking Agents for Grafting Cyclodextrins onto Cotton and Wool Fabrics: Study of the Process Parameters," Jopurnal of Applied Polymer Science, vol. 83 pp. 1449-1456. (Year: 2002).*

Patil, Sachin, in "Crosslinking of Polysaccharides: Methods and Application," Latest reviews, vol. 6, Issue 2, pp. 1-10. (Year: 2008).*

Rojas et al., in "Functionalization and Crosslinking of Microcrystalline Cellulose in Aqueous Media: A Safe and Economic Approach," International Journal of Pharmaceutical Sciences Review and Research, vol. 8, Issue 1, pp. 28-36. (Year: 2011).*

(56) References Cited

OTHER PUBLICATIONS

Mali et al., in "Citric Acid Crosslinked Carboxymethyl Cellulose-based Composite Hydrogel Films for Drug Delivery," Indian Journal of Pharmaceutical science, vol. 80, issue 4, pp. 657-667. (Year: 2018).*

* cited by examiner

CROSSLINKING/FUNCTIONALIZATION SYSTEM FOR A PAPER OR NON-WOVEN WEB

CROSS-REFERENCE TO RELATED APPLICATIONS

This application claims priority to PCT international application number PCT/EP2014/050152, filed Jan. 7, 2014, the subject matter of which is incorporated in its entirety by reference herein.

FIELD OF THE INVENTION

The present invention relates to a paper or non-woven web comprising fibers and a specific crosslinking or functionalization agent, a method for producing the paper or non-woven web or air-laid web and the use of the crosslinking or functionalization agent in a paper or non-woven web.

BACKGROUND OF THE INVENTION

A paper or non-woven web can be used for various purposes. Examples thereof include the use as packaging material, such as for food packaging; filter material, such as for infusion beverages, e.g. tea and coffee, or for oil filtration; composite laminates, such as overlay paper; metallized paper suitable for labels or packages; air laid non-woven webs, such as hygiene and personal care products, home care products, e.g. wipes, towels, napkins and tablecloths, speciality papers, e.g. wallcoverings (wall paper), mattress and upholstery padding, just to name a few.

Depending on its use, a paper or non-woven web has to fulfil various properties, such as tensile strength in a dry state and/or in a wet state, porosity, adherence, wettability, hydrophilicity/hydrophobicity. After use, it might be necessary or advantageous that the paper or non-woven web can be decomposed. Accordingly, biodegradability is a further often desired property of a paper or non-woven web.

A paper or non-woven web typically comprises fibers mainly constituting the web, which may be natural fibers or synthetic fibers. In order to impart the desired properties to a paper or non-woven web, it is often necessary to modify its composition.

EP 0 943 731 A1 describes a filter material which controls wettability and water absorption by using an additive of an amphiphilic compound, such as carboxymethyl cellulose (CMC), or hydrophilic and hydrophobic compounds, such as styrene/acrylate copolymers.

However, the present inventors have found that the polysaccharides alone, proposed in EP 0 943 731 A1 as amphiphilic or hydrophilic compounds, provide fiber-fiber crosslinkages which are stable in a dry state, however insufficient in a wet state. While the hydrophobic compounds, such as styrene/acrylate copolymers, proposed in EP 0 943 731 A1 provide better wet-strength properties, they are based on mineral oil and therefore not desired from a viewpoint of conservation of resources and biodegradability.

Object of the Invention

The object of the present invention is to provide a paper or non-woven web, provided with specific properties according to requirements, and involving ecological advantages in terms of a biological basis and/or biodegradability.

In particular, the present invention aims at providing a crosslinking/functionalization system, such as a crosslinking or functionalization agent, that imparts specific desired properties to a paper or non-woven web, while being more environment-friendly than the hitherto known oil-based compounds.

SUMMARY OF THE INVENTION

The present invention relates to a paper or non-woven web, which comprises fibers and at least one crosslinking or functionalization agent selected from the group consisting of carboxylic acids, halogenated heteroaromatic compounds and salts thereof.

The present inventors have found that a crosslinking or functionalization agent as described herein is suitable for substituting the hitherto known oil-based compounds and can impart specific desired properties to a paper or non-woven web, such as a high tensile strength in both a dry state and in a wet state even under severe conditions for instance extreme pH values. The porosity, adherence, wettability or hydrophilicity/hydrophobicity of the paper or non-woven web can be easily controlled to the desired properties by appropriately selecting a specific crosslinking or functionalization agent as described herein as well as its amount or by combining it with other additives, such as polysaccharide additives, for instance carboxymethyl cellulose (CMC).

Accordingly, the present invention further relates to the use of a crosslinking or functionalization agent as described herein in a paper or non-woven web.

Moreover, the present invention relates to a process for producing a paper or non-woven web, characterized in that at least one crosslinking or functionalization agent as described herein is applied.

DETAILED DESCRIPTION OF THE INVENTION

Figure 1:
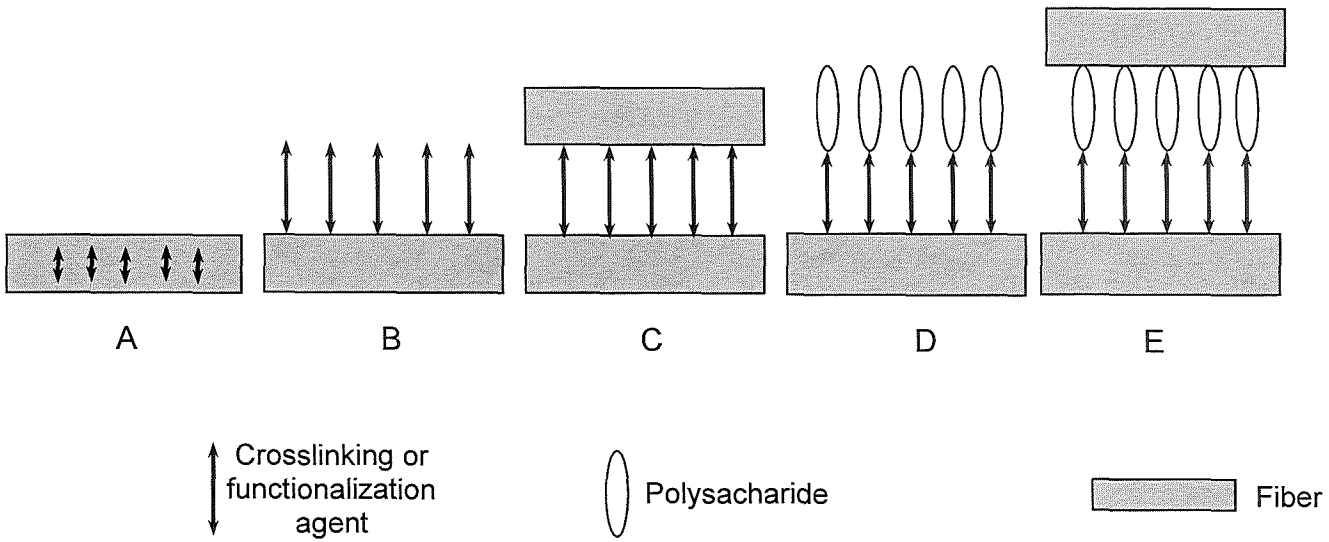
FIG. 1 is a schematic illustration of possibilities of using and/or combining the crosslinking or functionalization agent as described herein in a paper or non-woven web according to the present invention.

Hereinafter, details of the present invention and further features and advantages thereof will be described. However, the present invention is not limited to the following specific descriptions and embodiments, which are rather for illustrative purposes only.

Moreover, any disclosure or exemplary embodiment made herein in connection with the paper or non-woven web may also apply to a process for producing a paper or non-woven web as described herein and to a use of a crosslinking or functionalization agent as described herein and vice versa.

The present invention provides a paper or non-woven web, comprising fibers and being characterized in that it comprises at least one crosslinking or functionalization agent as described herein.

The molecular weight of the at least one crosslinking or functionalization agent is in particular not more than 1000 g/mol, in particular not more than 750 g/mol, in particular not more than 600 g/mol, in particular not more than 500 g/mol, in particular not more than 400 g/mol, in particular not more than 300 g/mol, and typically more than 50 g/mol, in particular more than 75 g/mol. In other words, the at least one crosslinking or functionalization agent is in particular not a polymeric compound.

In particular, the paper or non-woven web preferably does not comprise a polymeric (synthetic) binder, such as an acrylate polymer binder.

The paper or non-woven web according to the present invention can be for instance a packaging material, such as a packaging material for food packaging; a filter material, such as a filter material for infusion beverages, e.g. tea and coffee, or a filter material for oil filtration; a composite laminate, such as an overlay paper; a metallized paper, such as a metallized paper suitable for labels or packages; an air-laid non-woven web, such as a hygiene and personal care product, home care product, e.g. wipes, towels, napkins and tablecloths, a speciality paper, e.g. wallcoverings (wall paper), mattress and upholstery padding. Preferably, the paper or non-woven web according to the present invention is a filter material for tea and coffee.

The paper or non-woven web according to the present invention may be in particular an air-laid web or a wet-laid web.

The expressions "comprising" or "comprise", as used herein, do not only include the meaning of "comprising" or "comprise" but also encompass "consisting essentially of" or "consist essentially of" and "consisting of" or "consist of".

The term "crosslinking or functionalization agent" denotes a compound which is able to bind to fibers, preferably via covalent bonds, and is able to form crosslinkages or to functionalize fibers.

The terms "crosslinking" or "crosslinkages" as used herein do not only encompass the linking of two fibers or a fiber and a further additive, such as a polysaccharide additive, as will be described in further detail below, but also encompass the crosslinking within one fiber. The terms "crosslinking" or "crosslinkages" as used herein in particular encompasses linkages (e.g. the linking of two fibers, the linking of a fiber and a further additive, and/or the crosslinking within one fiber) within (in the interior) of the paper or non-woven web, and in particular not only on the surface of the paper or non-woven web.

The term "functionalization" as used herein denotes providing the paper or non-woven web with a certain functionality or certain functionalities, such as hydrophilic properties, hydrophobic properties, wettability, adherence, stability, tensile strength, resistance, and the like.

In the paper or non-woven web according to the present invention, at least a part of the crosslinking or functionalization agent is bound, in particular covalently bound, to the fibers. The term "at least a part of" as used herein may denote that in case of a combination of a carboxylic acid compound and a hypophosphite compound, as will be described in further detail below, at least one type of compound of the carboxylic acid compound and the hypophosphite compound is bound to the fibers, for instance at least the carboxylic acid is bound to the fibers. The term "at least a part of" as used herein may also denote that at least 5%, in particular at least 10%, in particular at least 20%, in particular at least 30%, in particular at least 40%, in particular at least 50%, in particular at least 60%, in particular at least 70%, in particular at least 80%, in particular at least 90%, and in particular up to 100 of the amount of the crosslinking or functionalization agent contained in the paper or non-woven web is bound to the fibers.

The crosslinking or functionalization agent according to the present invention is selected from the group consisting of carboxylic acids, halogenated heteroaromatic compounds and salts thereof.

The carboxylic acids are preferably selected from the group consisting of dicarboxylic acids, polycarboxylic acids, amino acids and salts thereof, more preferably from the group consisting of aliphatic dicarboxylic acids, aliphatic polycarboxylic acids, aliphatic amino acids and salts thereof.

Particularly preferred dicarboxylic acids are maleic acid, fumaric acid, oxalic acid, malonic acid, succinic acid, adipic acid and salts thereof.

Particularly preferred polycarboxylic acids are citric acid, butane tetracarboxylic acid, iminodisuccinic acid and salts thereof.

Particularly preferred amino acids are aspartic acid, glutamic acid and salts thereof.

The most preferred carboxylic acids are citric acid and its sodium salts, butane tetracarboxylic acid, in particular butane 1,2,3,4-tetracarboxylic acid, and its sodium salts and aspartic acid.

The halogenated heteroaromatic compounds may contain one or more halogen atoms, selected independently from each other from the group consisting of F, Cl, Br and I.

The halogenated heteroaromatic compounds are preferably halogenated nitrogen-containing heteroaromatic compounds and salts thereof, more preferably chlorinated nitrogen-containing heteroaromatic compounds and salts thereof.

Particularly preferred halogenated heteroaromatic compounds are halogenated triazine compounds and salts thereof, in particular chlorinated triazine compounds and salts thereof.

The most preferred halogenated heteroaromatic compound is 4,6-dichloro-1,3,5-triazin-2-ol and its sodium salt (NHDT).

The most preferred crosslinking or functionalization agents according to the present invention are citric acid and 4,6-dichloro-1,3,5-triazin-2-ol and its sodium salt (NHDT).

The present inventors have found that in case of the crosslinking or functionalization agent comprising a carboxylic acid, it is advantageous that the carboxylic acid is in its acidic form. In other words, salts of carboxylic acids may be less preferred.

The present inventors have found that in case of the crosslinking or functionalization agent comprising a carboxylic acid, such as dicarboxylic acid or a polycarboxylic acid, in particular citric acid, it is advantageous that additionally at least one hypophosphite compound is comprised. The at least one hypophosphite (phosphinate) compound may in particular be a salt of hypophosphorous acid (phosphinic acid, $H_3PO_2$), in particular a sodium salt thereof, such as sodium hypophosphite (sodium phosphinate, $NaH_2PO_2$). Thereby, the paper or non-woven web according to the present invention shows particularly advantageous properties in terms of biodegradability and tensile strength. The content of the hypophosphite compound agent in the paper or non-woven web is preferably 0.1 to 10 wt.-% based on the total weight of the paper or non-woven web, in particular 0.2 to 5.0 wt.-%, in particular 0.3 to 4.0 wt.-%, in particular 0.4 to 3.0 wt.-%, in particular 0.5 to 2.5 wt.-%.

The content of the crosslinking or functionalization agent in the paper or non-woven web according to the present invention is preferably up to 50 wt.-% based on the total weight of the paper or non-woven web, more preferably 0.01 to 40 wt.-%, still more preferably 0.02 to 30 wt.-%, still more preferably 0.03 to 25 wt.-%, still more preferably 0.04 to 20 wt.-%, still more preferably 0.05 to 15 wt.-% and most preferably 0.1 to 10 wt.-%, in particular 0.5 to 10 wt.-%, in particular 1.0 to 10 wt.-%, such as 1.0 to 5.0 wt.-% or 2.0 to 10 wt.-%. These content values are to be understood that the content of the at least one hypophosphite compound—if present—is encompassed.

For example, the paper or non-woven web may comprise from 1.0 to 5.0 wt.-% of carboxylic acid (such as citric acid) and from 0.5 to 2.5 wt.-% of the at least one hypophosphite compound (such as sodium hypophosphite), all based on the total weight of the paper or non-woven web.

In a preferred embodiment, the paper or non-woven web according to the present invention further comprises at least one polysaccharide additive. Preferred examples of the polysaccharide additive include carboxymethyl cellulose (CMC), starch, alginic acid or alginates, pectin and mixtures thereof, in particular carboxymethyl cellulose (CMC). The polysaccharide additive is preferably linked (bound, such as covalently bound) to the fibers of the paper or non-woven web by the crosslinking or functionalization agent.

By comprising at least one polysaccharide additive, further functionalities can be imparted to the paper or non-woven web according to the present invention and the tensile strength of the paper or non-woven web according to the present invention can be further improved in addition to comprising the crosslinking or functionalization agent.

The content of the at least one polysaccharide additive in the paper or non-woven web according to the present invention is preferably up to 30 wt.-% based on the total weight of the paper or non-woven web, in particular from 0.1 to 20 wt.-%, in particular from 0.25 to 15 wt.-%, in particular from 0.5 to 10 wt.-%, in particular from 0.75 to 5.0 wt.-%, in particular from 1.0 to 3.0 wt.-%.

For example, the paper or non-woven web may comprise from 1.0 to 5.0 wt.-% of carboxylic acid (such as citric acid), from 0.5 to 2.5 wt.-% of the at least one hypophosphite compound (such as sodium hypophosphite) and from 1.0 to 3.0 wt.-% of the at least one polysaccharide additive (such as CMC), all based on the total weight of the paper or non-woven web.

Further additives can be contained in the paper or non-woven web according to the present invention depending on the intended use of the paper or non-woven web. For instance, abrasive-resistant or hard material particles, such as corundum or glass beads, may be contained, in particular when used as an overlay paper.

The fibers contained in the paper or non-woven web according to the present invention are not particularly limited as long as they can bind to the crosslinking or functionalization agent.

Suitable fibers are natural fibers or cellulosic fibers. Preferred examples include fibers of cellulose, viscose, lyocell, cotton, hemp, manila, jute, sisal, rayon, abaca and others, and also include fibers of soft wood pulp and hard wood pulp.

Further suitable fibers are synthetic fibers or heat-sealable fibers. Preferred examples include fibers of polyethylene (PE), polypropylene (PP), polyester, such as polyethylene terephthalate (PET) and poly(lactic acid) (PLA). Further preferred examples include bicomponent fibers, preferably bicomponent fibers of the sheath-core type. Bicomponent fibers are composed of two sorts of polymers having different physical and/or chemical characteristics, in particular different melting characteristics. A bicomponent fiber of the sheath-core type typically has a core of a higher melting point component and a sheath of a lower melting point component. Examples of bicomponent fibers, suitable for use in the present invention, include PET/PET fibers, PE/PP fibers, PET/PE fibers and PLA/PLA fibers.

It is also possible to use mixtures of the above fibers, such as mixtures of two or more natural fibers, mixtures of two or more synthetic fibers or heat-sealable fibers, mixtures of natural fibers and synthetic fibers or heat-sealable fibers and any combinations thereof.

The grammage of the paper or non-woven web is not particularly limited. Typically, the paper or non-woven web has a grammage of from 5 to 2000 g/m$^2$, preferably from 50 to 600 g/m$^2$ or from 8.5 to 120 g/m$^2$.

The length and the coarseness of the fibers are not particularly limited. The coarseness of a fiber is defined as the weight per unit length of the fiber. Typically, the natural fibers or cellulosic fibers have a length of 1 to 15 mm, preferably from 3 to 10 mm. Typically, the natural fibers or cellulosic fibers have a coarseness of from 30 to 300 mg/km, preferably from 70 to 150 mg/km. Typically, the synthetic fibers or heat-sealable fibers have a length of from 1 to 15 mm, preferably from 2 to 12 mm. The heat-sealable fibers suitable for use in the present invention typically have a coarseness of from 0.1 to 5 dtex, preferably from 0.3 to 3 dtex.

FIG. 1 is a schematic illustration of possibilities of using and/or combining the crosslinking or functionalization agent in a paper or non-woven web according to the present invention.

In Example A, the crosslinking by the crosslinking or functionalization agent occurs within one fiber which enhances the mechanical stability, such as the resistance to grinding or resin take-up, of the fiber.

In Example B, the crosslinking or functionalization agent binds to the fiber and thereby imparts a certain functionality or certain functionalities to the fiber. For instance, when a polycarboxylic acid or an amino acid, such as citric acid, butane tetracarboxylic acid, aspartic acid or salts thereof, are used as the crosslinking or functionalization agent, the hydrophilicity and the wettability of the paper or non-woven web according to the present invention can be increased. When a halogenated heteroaromatic compound, such as 4,6-dichloro-1,3,5-triazin-2-ol or its sodium salt (NHDT), is used as the crosslinking or functionalization agent, the hydrophobicity and the wet tensile strength, in particular under alkaline conditions, of the paper or non-woven web according to the present invention can be increased. Moreover, the resistance to grinding of the fibers can be enhanced.

In Example C, two fibers are crosslinked by the crosslinking or functionalization agent thereby improving characteristic properties, such as the tensile strength in the dry and in the wet state, the hydrophobic/hydrophilic wettability and the resistance to resin take-up, of the paper or non-woven web according to the present invention.

In Example D, the crosslinking or functionalization agent binds a polysaccharide additive via the crosslinking or functionalization agent to a fiber, thereby imparting further functionalities to the paper or non-woven web according to the present invention and further improving characteristic properties, such as the tensile strength, of the paper or non-woven web according to the present invention.

In Example E, two fibers are crosslinked via the crosslinking or functionalization agent and a polysaccharide additive, thereby further improving characteristic properties, such as the tensile strength, of the paper or non-woven web according to the present invention.

Of course, further possibilities and combinations other than the above exemplified Examples A to E are possible and the paper or non-woven web according to the present invention may comprise any combinations of the above exemplified Examples A to E and the further possibilities and combinations.

The crosslinking or functionalization agents according to the present invention preferably have at least two moieties capable of binding to the fibers and optionally the polysaccharide additive.

For instance, citric acid and butane tetracarboxylic acid, which are preferred crosslinking or functionalization agents according to the present invention, comprise three and four carboxylic acid moieties, respectively, capable of forming for example ester bonds with hydroxyl groups of the fibers and/or the optional polysaccharide additive. It is not necessary that all carboxylic acid moieties of these crosslinking or functionalization agents react, and any remaining unreacted carboxylic acid moieties may contribute to a further functionalization of the paper or non-woven web according to the present invention.

4,6-dichloro-1,3,5-triazin-2-ol sodium salt (NHDT), which is a further preferred crosslinking or functionalization agent according to the present invention, comprises two chlorine atoms which can be independently substituted. Moreover, bonds via the nitrogen atoms of NHDT can be formed.

As exemplary illustrations, some typical reaction schemes of 4,6-dichloro-1,3,5-triazin-2-ol sodium salt (NHDT) with a cellulosic fiber (OH-Cell) and/or carboxymethyl cellulose (CMC) are shown in the following:

(1)

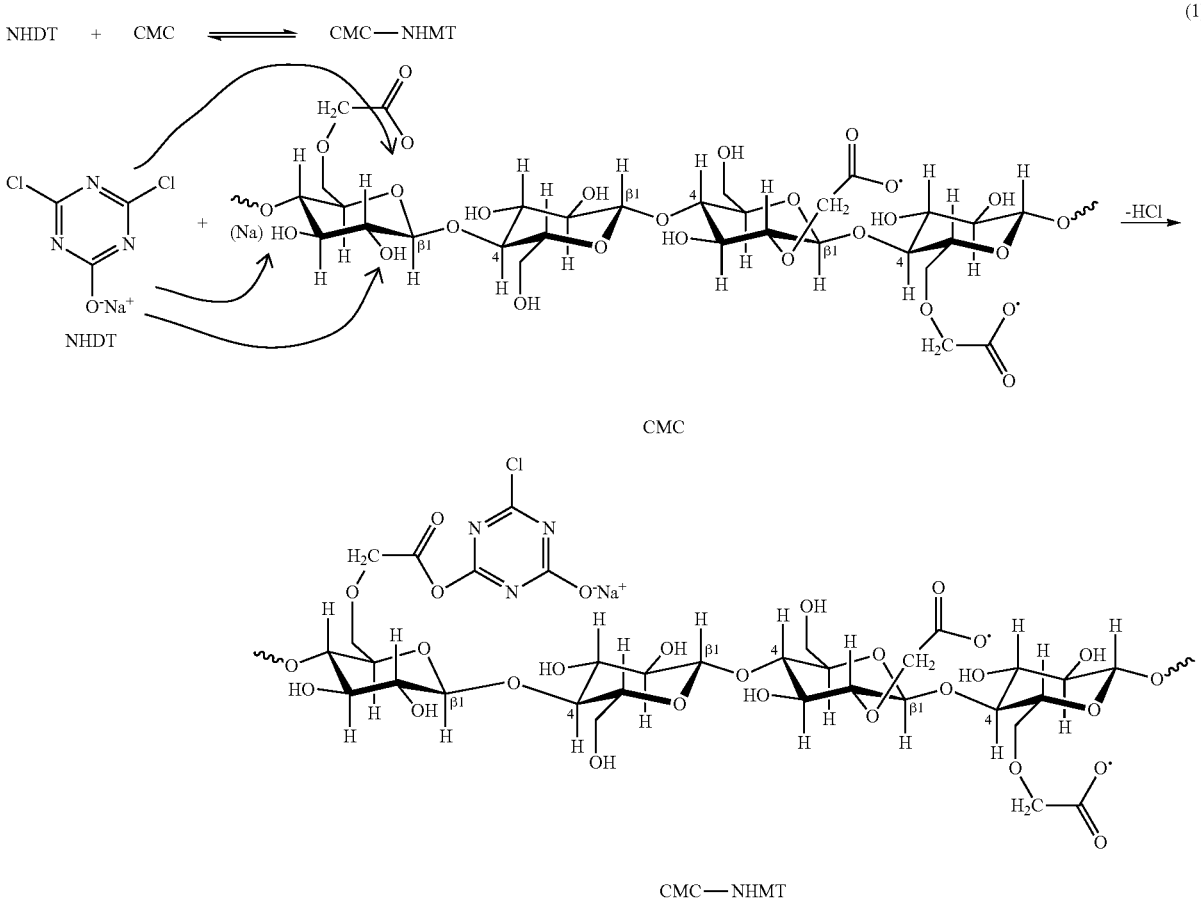

(2)

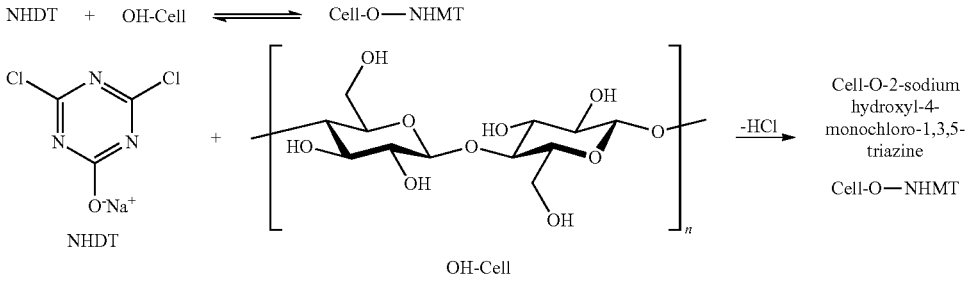

(3)

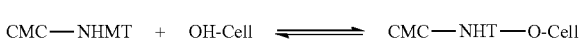

-continued

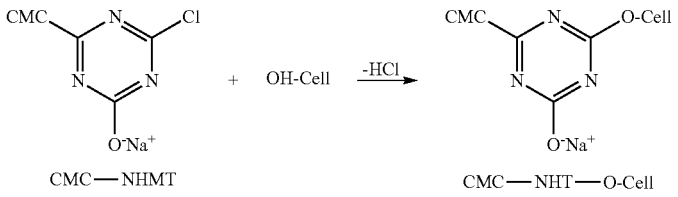

The paper or non-woven web according to the present invention can be prepared by a conventional paper-making process using a paper machine, preferably an inclined wire paper machine, or a dry-forming air-laid non-woven manufacturing process, wherein additionally at least one crosslinking or functionalization agent as defined herein is applied. A conventional paper-making process is described for instance in US 2004/0129632 A1, the disclosure of which is incorporated herein by reference. A suitable dry-forming air-laid non-woven manufacturing process is described for instance in U.S. Pat. No. 3,905,864, the disclosure of which is incorporated herein by reference.

The process for producing a paper or non-woven web according to the present invention is characterized in that at least one crosslinking or functionalization agent as defined herein is applied.

Preferred application modes of the crosslinking or functionalization agent are as follows:

While the following preferred application modes are described with NHDT as an example of the crosslinking or functionalization agent according to the present invention, a cellulosic fiber as an example of a fiber according to the present invention and CMC as an example of the optional polysaccharide additive according to the present invention, these preferred application modes shall not be construed as limited to these specific examples but also apply to the other crosslinking or functionalization agents, fibers and optional polysaccharide additives according to the present invention.

(1) Application of NHDT and CMC in Separate Steps:

(a) applying NHDT to the cellulosic fiber to give Cell-O-NHMT (pH, temperature)

(b) rinsing (c) applying CMC to Cell-O-NHMT to give Cell-O-NHT-CMC (pH, temperature)

(d) optionally rinsing (2) Application of a Mixture of NHDT and CMC in One Step:

(a) applying NHDT and CMC to the cellulosic fiber (b) optionally rinsing (3) Application of a Previously Functionalised CMC:

(a) applying a previously functionalised CMC (NHMT-CMC) to the cellulosic fiber to give CMC-NHT-O-Cell (b) optionally rinsing The latter approach, i.e. application mode (3), is in particular advantageous in that a rinsing step of any remaining excessive NHDT is not necessary.

Various modifications thereof are possible, for instance the crosslinking or functionalization agent and optionally the polysaccharide additive can be added to the fibers before applying to the paper machine whereby reactions between the crosslinking or functionalization agent and the fibers and optionally the polysaccharide additive take place in-mass.

The crosslinking or functionalization agent as described herein can be used in a paper or non-woven web, for instance a packaging material, such as a packaging material for food packaging; a filter material, such as a filter material for infusion beverages, e.g. tea and coffee, or a filter material for oil filtration; a composite laminate, such as an overlay paper; a metallized paper, such as a metallized paper suitable for labels or packages; an air-laid non-woven web, such as a hygiene and personal care product, home care product, e.g. wipes, towels, napkins and tablecloths, a speciality paper, e.g. wallcoverings (wall paper), mattress and upholstery padding. Preferably, the crosslinking or functionalization agent as described herein can be used in a filter material for tea and coffee. In particular, the crosslinking or functionalization agent as described herein can be used for imparting tensile strength (in a dry state and/or in a wet state), porosity, wettability, hydrophilicity/hydrophobicity and/or adherence to a paper or non-woven web. In addition, the crosslinking or functionalization agent as described herein can be used for imparting biodegradability to a paper or non-woven web.

EXAMPLES

A paper or non-woven web of a mixture of softwood and abaca fibers has been prepared (Reference Example).

To the mixture as used in the Reference Example, further compounds, as indicated below, have been added to prepare paper or non-woven webs of the Examples according to the present invention and Comparative Examples:

Example 1: Alginate/Citric Acid (9%)

Example 2: NHDT/Alginate (9%)

Example 3: NHDT/Pectin (9%)

Example 4: NHDT 7.3%

Example 5: Citric Acid 10%

Comparative Example 1: CMC 2%

Comparative Example 2: Styrene/Acrylate (6%)

The tensile strength of the samples according to the Reference Example, the Examples according to the invention and the Comparative Examples in the dry state, in the wet state and in the wet state additionally comprising 6% NaOH (i.e. under alkaline conditions) where determined. The dry tensile strength was determined in accordance with ISO 1924-2 and the wet tensile strengths were determined in accordance with ISO 3781.

Figure 2:
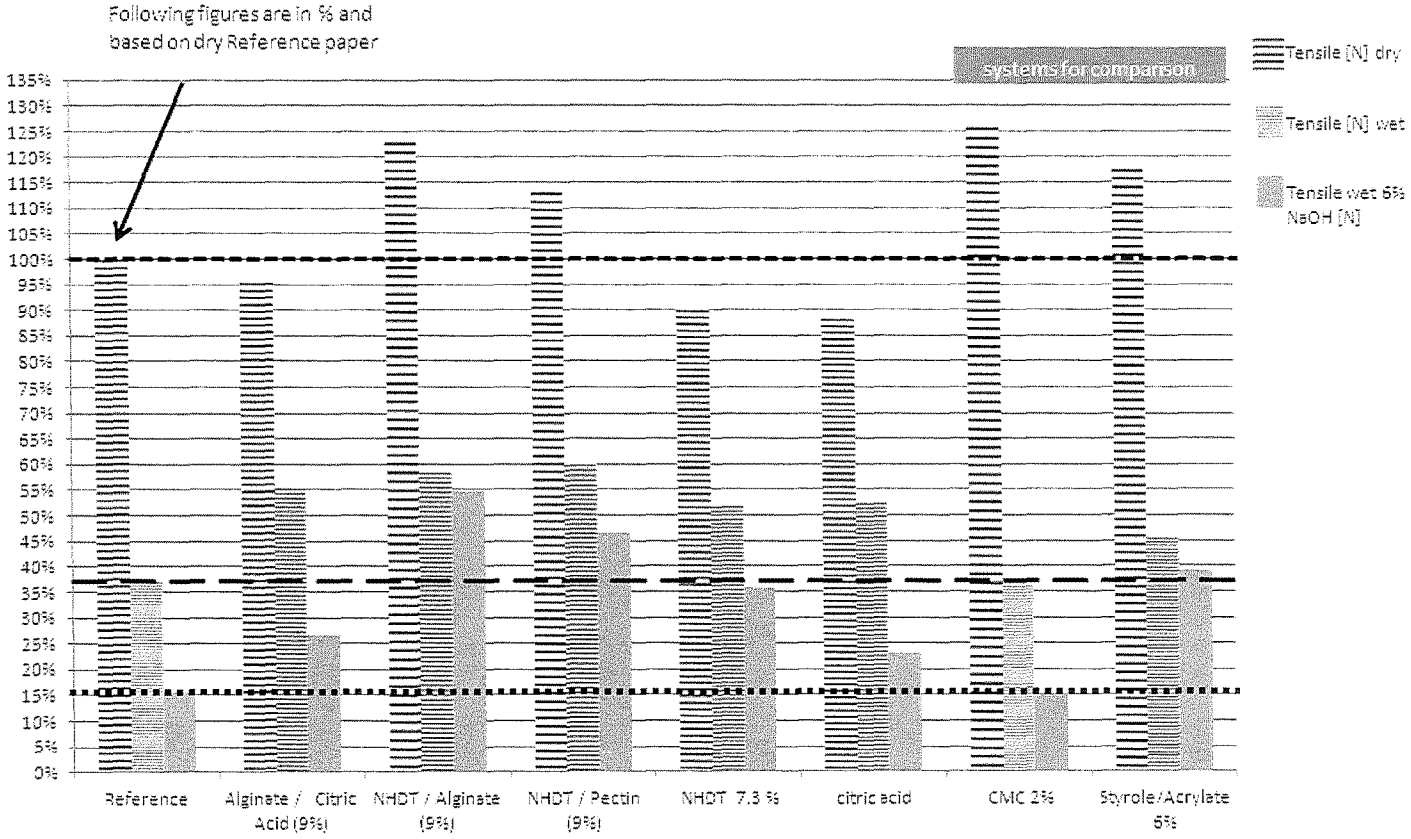
FIG. 2 is a diagram showing experimental results of measuring the tensile strength of paper or non-woven webs according to the present invention and the prior art.

The results are shown in FIG. 2.

As it is evident from these results, the paper or non-woven web according to the present invention has superior properties in particular in terms of wet tensile strength in comparison with conventional paper where only a polysaccharide additive, such as CMC (Comparative Example 1), has been used. Moreover, the crosslinking or functionalization agent according to the present invention represents a suitable substitute for the conventional oil-based compounds, such as styrene/acrylate copolymers (Comparative Example 2).

While the present invention has been described in detail by way of specific embodiments and examples, the invention is not limited thereto and various alterations or modifications are possible, without departing from the scope of the invention.

The invention claimed is:

1. A paper or non-woven web, comprising fibers, at least one polysaccharide additive, and at least one crosslinking or functionalization agent selected from the group consisting of carboxylic acids, halogenated heteroaromatic compounds and salts thereof, wherein said at least one crosslinking or functionalization agent has a molecular weight of not more than 1000 g/mol, wherein at least a part of said crosslinking or functionalization agent is covalently bound to said fibers, and wherein said at least one polysaccharide additive is linked to said fibers via said at least one crosslinking or functionalization agent by covalent bonds.

2. The paper or non-woven web according to claim 1 which is an air-laid web or a wet-laid web.

3. The paper or non-woven web according to claim 1, wherein said crosslinking or functionalization agent is selected from the group consisting of dicarboxylic acids, polycarboxylic acids, amino acids, halogenated nitrogen-containing heteroaromatic compounds and salts thereof.

4. The paper or non-woven web according to claim 1, wherein said crosslinking or functionalization agent is selected from the group consisting of aliphatic dicarboxylic acids, aliphatic polycarboxylic acids, aliphatic amino acids, chlorinated nitrogen-containing heteroaromatic compounds and salts thereof.

5. The paper or non-woven web according to claim 1, wherein said crosslinking or functionalization agent is selected from the group consisting of citric acid, butane tetracarboxylic acid, maleic acid, fumaric acid, oxalic acid, malonic acid, succinic acid, adipic acid, aspartic acid, glutamic acid, iminodisuccinic acid, chlorinated triazine compounds and salts thereof.

6. The paper or non-woven web according to claim 1, wherein said crosslinking or functionalization agent is 4,6-dichloro-1,3,5-triazin-2-ol or its sodium salt.

7. The paper or non-woven web according to claim 1, wherein said crosslinking or functionalization agent is citric acid.

8. The paper or non-woven web according to claim 1, wherein said crosslinking or functionalization agent comprises a carboxylic acid and further comprises at least one hypophosphite compound.

9. The paper or non-woven web according to claim 1, wherein said polysaccharide additive is selected from the group consisting of carboxymethyl cellulose, starch, alginic acid or alginates, and pectin.

10. The paper or non-woven web according to claim 1, wherein said fibers comprise cellulosic fibers.

11. The paper or non-woven web according to claim 1 wherein said fibers comprise heat-sealable fibers.

* * * * *